US005779653A

United States Patent [19]

Thompson

[11] Patent Number: 5,779,653

[45] Date of Patent: Jul. 14, 1998

[54] BACK SCRUBBING AND MASSAGING APPARATUS

[76] Inventor: Michael R. Thompson, 16460 Highway 3 #906, Webster, Tex. 77598

[21] Appl. No.: 709,714

[22] Filed: Sep. 9, 1996

[51] Int. Cl.[6] ..... A47K 7/02

[52] U.S. Cl. ..... 601/136; 601/134

[58] Field of Search ..... 601/131–138, 601/23, 27, 34; 482/51, 52, 72, 142

[56] References Cited

U.S. PATENT DOCUMENTS

| | | | |
|---|---|---|---|
| 1,618,165 | 2/1927 | Boschelli | 601/136 |
| 3,507,010 | 4/1970 | Doleman | 18/21 |
| 3,729,364 | 4/1973 | Doleman | 161/36 |
| 4,568,581 | 2/1986 | Peoples, Jr. | 428/35 |
| 4,704,759 | 11/1987 | Mesa | 15/160 |
| 4,890,352 | 1/1990 | Stowers | 15/244.1 |
| 4,943,018 | 7/1990 | Glaser | 248/110 |
| 5,072,480 | 12/1991 | Peters et al. | 601/136 |
| 5,159,896 | 11/1992 | Mortillo | 119/505 |
| 5,175,896 | 1/1993 | Zamir | 4/606 |
| 5,179,755 | 1/1993 | Hill | 601/136 |
| 5,311,635 | 5/1994 | Moore | 601/136 |

FOREIGN PATENT DOCUMENTS

| | | | |
|---|---|---|---|
| 452599 | 11/1948 | Canada | 601/136 |
| 13246 | 8/1956 | Germany | 601/136 |

*Primary Examiner*—Jerome Donnelly
*Attorney, Agent, or Firm*—Harrison & Egbert

[57] ABSTRACT

A back scrubbing and massaging apparatus having a backing surface, a plurality of molded multi-fingered clusters extending outwardly from one side of the backing surface, a support bar affixed to an opposite side of the backing surface from the plurality of multi-fingered clusters, and at least one suction cup connected to the backing surface and extending outwardly from the opposite side. The support bar includes a first support bar extending longitudinally along and adjacent to a first edge of the backing surface and a second support bar extending longitudinally along and adjacent to an opposite edge of the backing surface. A first suction cup is affixed to one end of the first support bar. A second suction cup is affixed to an opposite end of the first support bar. A third suction cup is affixed to one end of the second support bar. A fourth suction cup is affixed to an opposite end of the second support bar.

12 Claims, 6 Drawing Sheets

BACK SCRUBBING AND MASSAGING APPARATUS

TECHNICAL FIELD

The present invention relates to a cleaning device. More particularly, the present invention relates to a device and apparatus for use in cleaning, scrubbing or massaging one's back and which is adapted to be mounted temporarily on a location in a shower stall. Additionally, the present invention relates to devices that can be secured by suction cups to the wall of a tub or shower enclosure.

BACKGROUND ART

Back brushes generally have taken the form of a brush with a long handle in which the user can reach around and scrub his or her own back. Back brushes with both fixed and detachable handles have been available heretofore. Although such back brushes have been generally satisfactory, they have not been without some drawbacks due to their manner of use. It will be appreciated that a fair amount of physical flexibility and coordination is required for their effective use. People with stiff necks, backs, shoulders or other joints may not be able to use such back brushes, or if so only with difficulty. Moreover, the typical back brush of the prior art is relatively small and flat and is only suited for relatively localized scrubbing over a limited area with limited pressure.

The use of such hand held devices tends to restrict the simultaneous coverage of both upper and lower portions of the back. As a result, the hand-held back scrubbing devices of the prior art do not allow for maximum epidermal excitement. The rigid materials also pose a risk of minor damage to the outer epidermal layers.

Other devices made from organic and non-organic sponge materials do not provide efficient resistance for maximizing temporary relief of epidermal irritation. Additionally, the porous nature of a sponge poses a greater sanitary risk to the user due to bacteria which can be harbored in the pores of the material. This can further irritate and/or contaminate epidermal areas associated with the usage of such sponge materials.

In the past, a variety of patents have issued relating to back scrubbing devices. For example, U.S. Pat. No. 3,577,985, issued on May 11, 1971, to M. A. Guffin, describes a back scrubbing and massaging device having a nonbrush element comprising a plurality of deformable rollers loosely held within the framework of the device. It is adapted to be removably secured in a bathtub or on the wall of a standing shower in a position from which the bather can readily massage, scratch or wash his back by rubbing against the rollers without the use of his hands either on the invention or at his back.

U.S. Pat. No. 4,704,759, issued on Nov. 10, 1987, to O. Mesa teaches a back scrubbing device comprising a plate having a main surface from which there extends a plurality of suction cups adapting the device to be mounted to a shower stall wall in a temporary location. A plurality of bristles extend from the main surface against which one may rub the back to clean it after it has been soaped.

U.S. Pat. No. 4,890,352, issued on Jan. 2, 1990, to Stowers et al. describes a back washer which includes a sponge rubber washing member affixed to a flat flexible rubber base plate. This base plate can be removably mounted to a flat surface so that a person can wash their back against the washing member when in the shower and bathtub.

U.S. Pat. No. 4,943,018, issued on Jul. 24, 1990, to Glaser et al. describes a wall-mounted back brush which includes a base, bristles mounted thereon, and suction cups secured thereto. The suction cups are secured in an adjustable spaced apart relationship. The base is preferably curved in accordance with the curvature of the lumbar region.

U.S. Pat. No. 5,072,480, issued on Dec. 17, 1991, to Peters et al. describes a back brush assembly arranged for mounting in a fixed relationship relative to a shower wall. This assembly includes a rigid support plate with a matrix of suction cups mounted to a rear surface thereof. Alternating resilient and deformable polymeric projections are arranged in rows alternating with bristle brush rows. Each of these is of an equal predetermined length.

U.S. Pat. No. 5,175,896, issued on Jan. 5, 1993, to A. Zamir describes a bathroom accessory which includes a base member, suction cups on one face of the base member for removably mounting the accessory to a mounting surface, and a plurality of projections projecting from the opposite face of the base member. The suction cups allow the base member to be secured to the wall of a shower or to the wall adjacent to a bathtub. The plurality of projections project from the opposite face of the base member for massaging the back of the user when the accessory is mounted to the mounting surface. A flexible back-cleaning pad is removably attached to cover the outer tips of at least some of the projections for cleaning the back of the user.

U.S. Pat. No. 5,179,755, issued on Jan. 19, 1993, to Hill, Jr. teaches a pliable waterproof mat which has a rough fibrous surface and a woven backing. A fabric tape extends about the mat perimeter which, along with stitching, serves to hold the fabric closure pieces in place on the mat backing. A wall surface attachment is accomplished by the use of adhesively backed fabric closure pieces of either strip or patch shape with the latter used for temporary installation.

U.S. Pat. No. 5,228,165, issued on Jul 20, 1993, to Westberry et al. describes a wall mounted bath brush. This brush includes a plate portion having a front face and a rear face, a plurality of bristles extending from the front face, and an attachment mechanism for attaching the brush to a wall with the front face being directed away from the wall. The attachment mechanism provides removable attachment to a wall and may include a plurality of suction cups. The front face of the plate portion includes bristles which have a stiffness and an end roundness suitable for comfortably scratching a person's back when dry. The bristles are preferably provided in clusters. Each cluster of bristles may converge into a first end of a stem member extending through the plate portion.

It is an object of the present invention to provide a safe, sanitary, and convenient method of encouraging epidermal excitement of the upper and lower back simultaneously.

It is another object of the present invention to provide an apparatus that effectively scratches, scrubs, and massages the back.

It is a further object of the present invention to provide an apparatus that can be adjustably placed for maximizing the pressure benefits to the upper and lower dorsal torso simultaneously.

It is another object of the present invention to provide an apparatus that can be formed into a desired shape.

It is a further object of the present invention to provide an apparatus that is is easily manufactured, easy to use, and relatively inexpensive.

These and other objects and advantages of the present invention will become apparent from a reading of the attached specification.

SUMMARY OF THE INVENTION

The present invention is an improved back scratching, scrubbing, and massaging device. The present invention serves to relieve irritation and to excite the epidermal areas of the dorsal human torso. Additionally, the present invention is a back scratcher, scrubber, and/or massager which can either be used for the entire upper and lower portions of the back simultaneously or on isolated areas of the back, depending on the desires of the user. The device is a wall mounted for the comfort and convenience of the individual.

In particular, the present invention utilizes a sheet of ASTROTURF (™) which is produced as a thermoplastic, three-dimensional, molded multi-fingered product. The device of the present invention has a relatively flat matrix formed of parallel strips or ribs separated by hollow circular clusters or buds from which projections extend to simulate the motion of tiny fingers. The clusters do not abut one another. They are separated to provide air space in the matrix between adjacent clusters. The center of the hollow clusters and buds allows drainage to enable easier cleaning and quicker drying of the device for a more sanitary purpose. The projections or fingers of the clusters or buds are generally vertical to the backing surface. The bud lengths are approximately ¾ of an inch extending outwardly from the backing surface. The importance of the length of the bud with the finger-like projections relates to the maximum comfort attained by using the device.

In order to allow the present invention to be attached to a convenient surface, and to allow the present invention to be "formed" into a desired shape, a first support bar is affixed along one edge of the backing surface and a second support bar is affixed to an opposite edge of the backing surface. Each of the support bars is of a rigid and formable material such that the support bar retains a shape into which the bar is bent. A cross bar is connected to and extends between the first support bar and the second support bar. A first suction cup is connected to one end of the first support bar and a second suction cup is connected to an opposite end of the first support bar. Similarly, a third suction cup is connected to one end of the second support bar and a fourth suction cup is connected to an opposite end of the second support bar. Each of the suction cups is placed in proximity to separate corners of the backing surface. As such, the suction cups can be used so as to secure the formed backing surface to a wall.

In an alternative embodiment of the present invention, the first support bar extends diagonally across the backing surface while the second support bar extends diagonally across the backing surface generally transverse to the first support bar. The various suction cups are placed at the ends of the first and second support bars.

DETAILED DESCRIPTION OF THE INVENTION

Figure 1:
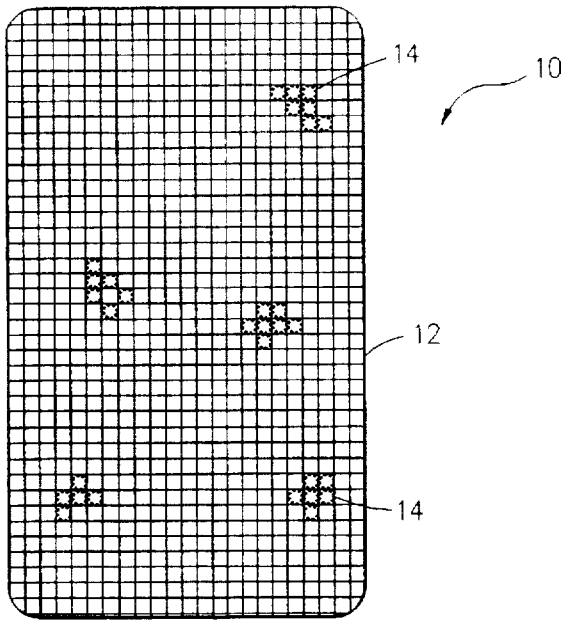
FIG. 1 is a front elevational view of the device in accordance with the preferred embodiment of the present invention.

Referring to FIG. 1, there is shown at 10 the back scrubbing and massaging apparatus in accordance with the preferred embodiment of the present invention. The back scrubbing and massaging apparatus includes a backing surface 12 having a plurality of hollow circular clusters or buds 14 which extend outwardly from the backing surface 12. In conventional nomenclature, the material used for the backing surface 12 and the buds 14 is ASTROTURF (™) material. This ASTROTURF (™) material is manufactured by Monsanto Company. This ASTROTURF (™) material is produced as a thermoplastic, three-dimensional, molded grass-like product, such as that shown in U.S. Pat. No. 3,507,010.

The clusters or buds 14 are distributed across the entire surface of the backing surface 12. The backing surface 12 is shown as having a generally rectangular configuration. In the preferred embodiment of the present invention, the backing surface 12 will have a length of 21 ¾ inches and a width of 13 ½ inches. Of course, the size will depend upon the size and shape of the user. For example, if the back scrubbing and massaging apparatus 10 were desired to be used for children, then the size could be much smaller. It is important that the size of the back scrubbing and massaging apparatus be suitable so as to simultaneously stimulate the upper and lower portions of the back.

Figure 3A:
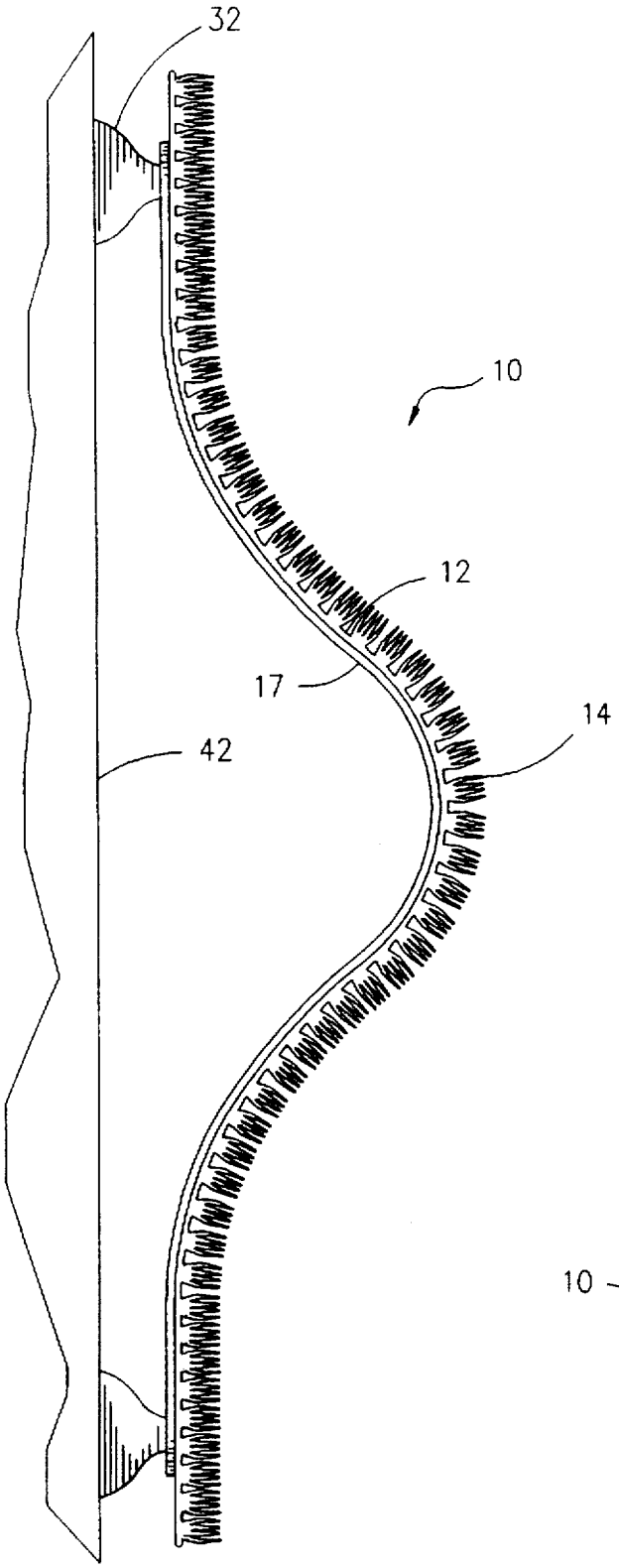
FIG. 3A is a side view showing the placement of the apparatus of the present invention onto a wall surface.
Figure 3B:
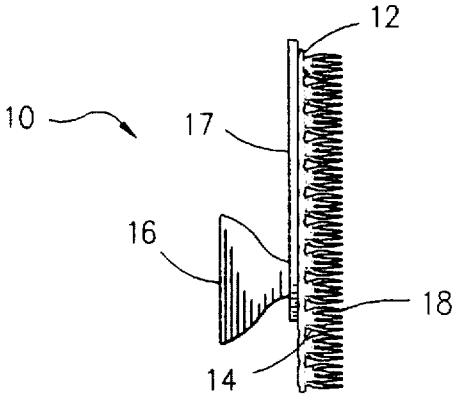
FIG. 3B is a detailed view of a particular corner of the apparatus of the present invention.

FIG. 3B shows an enlargement of a portion of the apparatus 10 from a side view perspective. It can be seen that the buds or clusters 14 extend outwardly from the backing surface 12. A clear thermoplastic suction cup 16 extends outwardly from the backing surface 12 opposite the buds 14. The suction cup 16 is connected to a support bar 17. The clusters or buds 14 do not abut one another. They are separated from one another to provide openings or holes in the matrix between adjacent clusters 14 and through the center of the hollow clusters 14 so as to allow drainage and to enable easier cleaning of the apparatus 10. The projections 18 found in each of the buds 14 are essentially vertical relative to the backing surface 12. Each of these projections 18 should have a length of approximately ¾ of an inch so as to effectively stimulate the massaging and scratching of the back while avoiding damage or irritation of the surface of the back. Each of the projections 18 on the clusters 14 is flat on the ends (not pointed) so as to avoid any irritation to the skin. Each of the projections 18 in each of the buds 14 acts as a small finger for the massaging action. The suction cup 16 extends outwardly from the backing surface 12 for a distance of approximately one inch. The suction cup 16 has a diameter of 2 ¼ inches. A plurality of such suction cups 16 are positioned on the backing surface 12 of the apparatus 10.

Figure 2A:
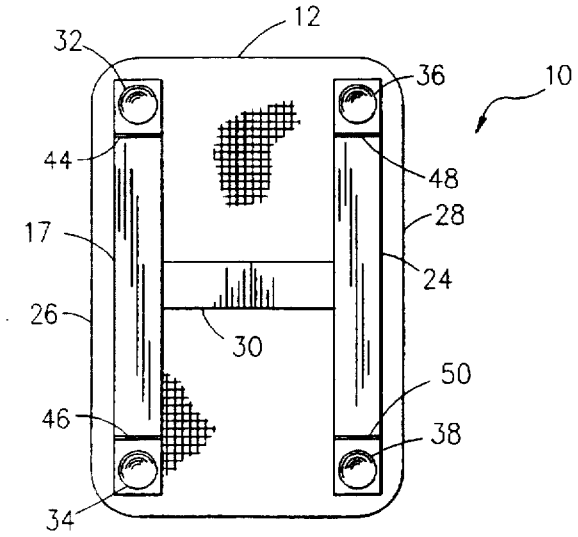
FIG. 2A is a rear view of the device in accordance with the preferred embodiment of the present invention.

FIG. 2A shows a rear view of the apparatus 10 of the present invention. In particular, it can be seen that a first support bar 17 and a second support bar 24 are affixed to the backing surface 12 of the apparatus 10. In particular, the first support bar 17 extends longitudinally along and adjacent to side edge 26 of the backing surface 12. The second support bar 24 extends longitudinally along and adjacent to edge 28 of the backing surface 12. The first support bar 17 is in parallel relationship to the second support bar 24. A cross bar 30 extends between the first support bar 17 and the second support bar 28. The cross bar 30 is positioned generally centrally of each of the support bars 17 and 24 and extends transversely thereto.

A first suction cup 32 is affixed at one end of the first support bar 17. A second suction cup 34 is affixed to an opposite end of the first support bar 17. Similarly, a third suction cup 36 is affixed to one end of the second support bar 24. A fourth suction cup 38 is affixed to an opposite end of the second support bar 24. Each of the suction cups 32, 34, 36 and 38 is positioned generally adjacent to separate corners of the backing surface 12. The suction cups 32, 34, 36 and 38 serve to secure the backing surface 12 of the apparatus 10 to a desired exterior surface (as shown in FIG. 3A).

Importantly, each of the support bars 17 and 24 is of a rigid formable material such that the support bar retains the shape into which the support bar is bent. As can be seen in FIG. 3A, the support bar 17 is bent so as to form a hump therein. In the preferred embodiment of the present invention, the support bar 17 is of a rubber-coated metal material. As such, when the support bar 17 is properly bent, it will retain its curved configuration. The backing surface 12 and the plurality of multi-fingered clusters 14 are affixed to a surface of the support bar 17. The suction cup 32 and the suction cup 34 engages the flat surface of wall 42 so as to secure the apparatus 10 of the present invention to a desired location. Since the "hump" is formed in the apparatus 10, the apparatus 10 is better configured to suit the needs of the individual. Various other forms of humps and shapes can be developed through the use of the configuration of support bars and the flexible backing material 12.

With reference to FIG. 2A, it can be seen that the first support bar 17 includes a hinge member 44 adjacent to the suction cup 32 and a hinge member 46 adjacent to the suction cup 34. Similarly, the second support bar 24 includes a hinge member 48 adjacent to the suction cup 36 and a hinge member 50 adjacent to the suction cup 38. These hinge members 44, 46, 48 and 50 can be "living" hinges which are formed in the material used for the support bars 17 and 24. The use of such hinges serves to resist any twisting forces that are exerted on the suction cups by the support bars 17 and 24. As such, these hinges serve to make the apparatus 10 more easily formable.

Figure 2B:
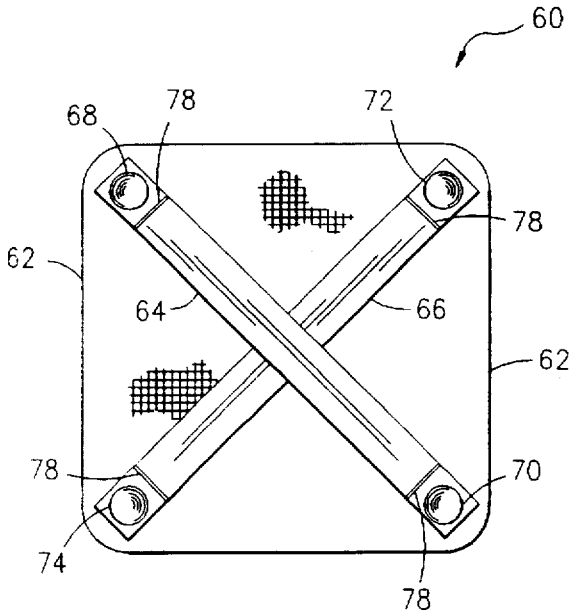
FIG. 2B is a rear view of an alternative embodiment of the device in accordance with the present invention.

The configuration of the present invention as shown in FIGS. 2A and 3A allows for the formation of a cylindrical hump. However, an alternative embodiment, as shown in FIG. 2, can allow for the formation of a spherical hump.

In FIG. 2B, it can be seen that the apparatus 60 has a backing surface 62. A first support bar 64 extends diagonally across the backing surface 62. A second support bar 66 extends diagonally across the backing surface 62 generally transverse to the first support bar 64. A first suction cup 68 is connected to one end of the first support bar 64 while a second suction cup 70 is connected to an opposite end of the first support bar 64. A third suction cup 72 is connected to one end of the second support bar 66 and a fourth suction cup 74 is connected to an opposite end of the second support bar 66. Suitable hinges, as described hereinbefore, are formed in the support bars 64 and 66 adjacent to each of the suction cups. As can be seen in FIG. 2B, these hinges 78 extend generally transverse to the longitudinal axis of each of the support bars. When the support bars 64 and 66 are bent into a desired configuration, a spherical hump is formed. In either of the embodiments shown in FIGS. 2A and 2B, the back scrubbing apparatus 10 of the present invention is formed in a manner which can better facilitate the scrubbing and massaging action of the multi-fingered clusters on the surface of the backing layer 12.

The construction of the apparatus is previously described in their preferred embodiments. However, this is not the only construction that may be used. Smaller, yet equally proportioned versions, may be employed for children.

Figure 4:
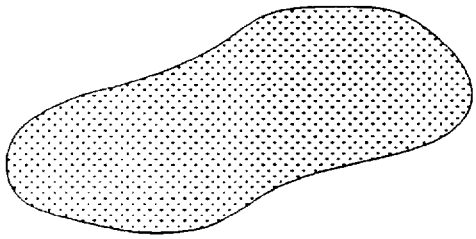
FIGS. 4–22 illustrate various other ways in which the material of the present invention can be used for a variety of other purposes.
Figure 6:
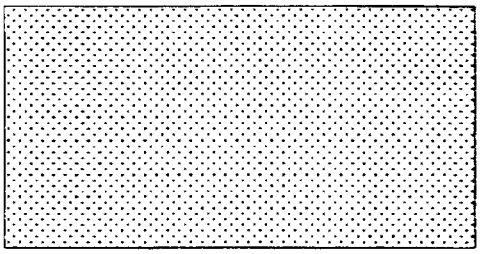
Figure 5:
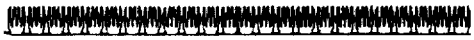
Figure 7:
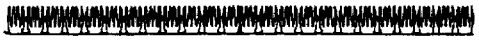

FIGS. 4–24 illustrate various alternative uses of the material of the present invention.

Where the present invention is used for the scrubbing of vegetables, the ASTROTURF (™) material is provided in the shape of a potato (as shown in FIGS. 4 and 5). It would not include the suction cups or other backing material. The buds as used on the material would be of a relatively short nature so the effective scrubbing of vegetables can be carried out. Alternatively, if the device is used as a dish, pot or pan scrubber (as shown in FIGS. 6 and 7), the material will be in a square configuration and will have short fingers. No backing material is provided when it is used as a dish, pan or pot scrubber.

Figure 8:
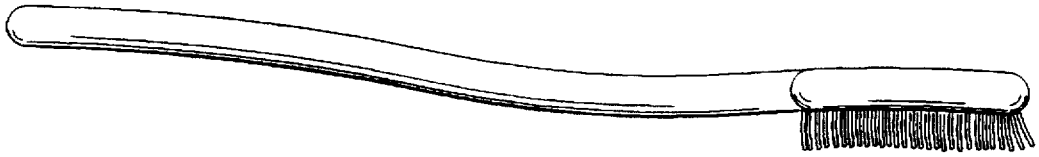
Figure 9:
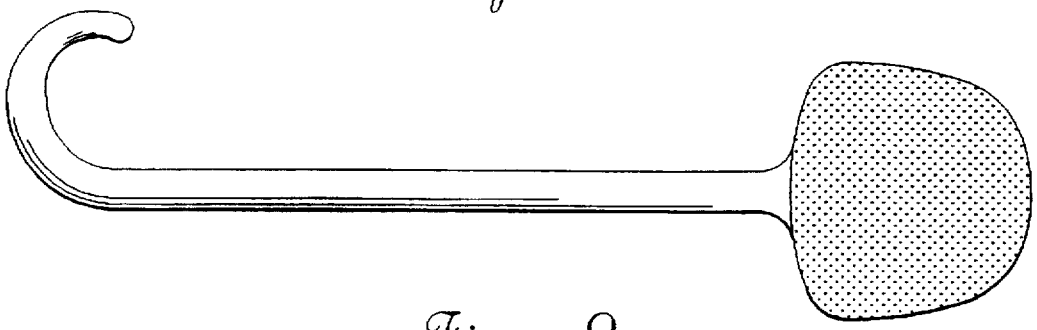
Figure 10:
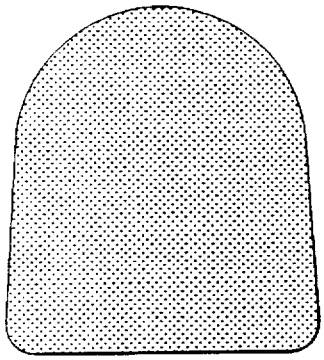
Figure 11:
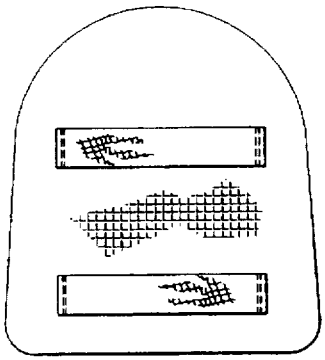
Figure 12:
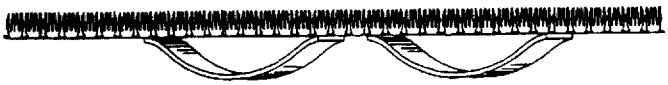

The present invention can also be used as a back scrubber if a handle is applied to the material (as shown in FIGS. 8 and 9). The material can be positioned on the end of a plastic handle such that it extends outwardly therefrom. The material would have medium or soft fingers. The plastic handle can have a hook so that the device can be hung in a shower. Still further, and alternatively, the material can be formed into a spherical configuration and affixed to the end of the handle. The present invention can be used as a scrubbing mitt by forming the material into the shape of a glove (as shown in FIGS. 10–12). Straps can extend across the back of the material so as to receive hands therein. As such, when the hand is inserted into the straps, the device can be used for scrubber the body in t he shower or for scratching the back out of the shower. It can also be made in a smaller configuration for children. When it is of a smaller nature, it would have a size of approximately one square foot.

Figure 13:
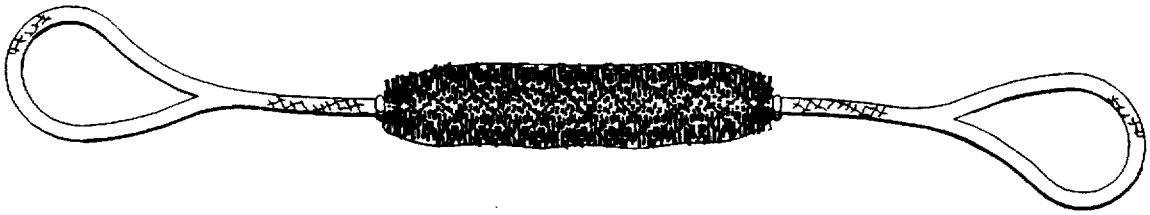

The present invention can also be configured so that the material can be placed on the interior of plastic netting (as shown in FIG. 13). As such, it can be seen like a rope on the person's back.

In another alternative embodiment, the present invention can be used as a back scratcher (as shown in FIGS. 8 and 9). In other words, the material can be fixed on the end of a wooden handle which is configured so as to conveniently scratch a back. The handle can have a curved configuration so that it can conveniently access the back.

Figure 14:
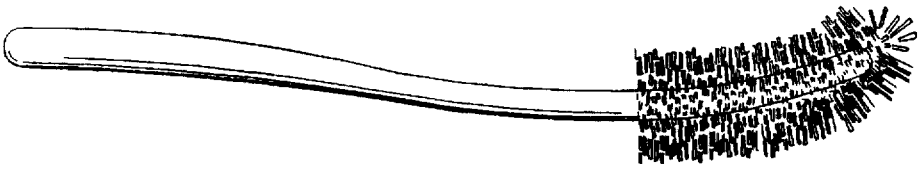
Figure 15:
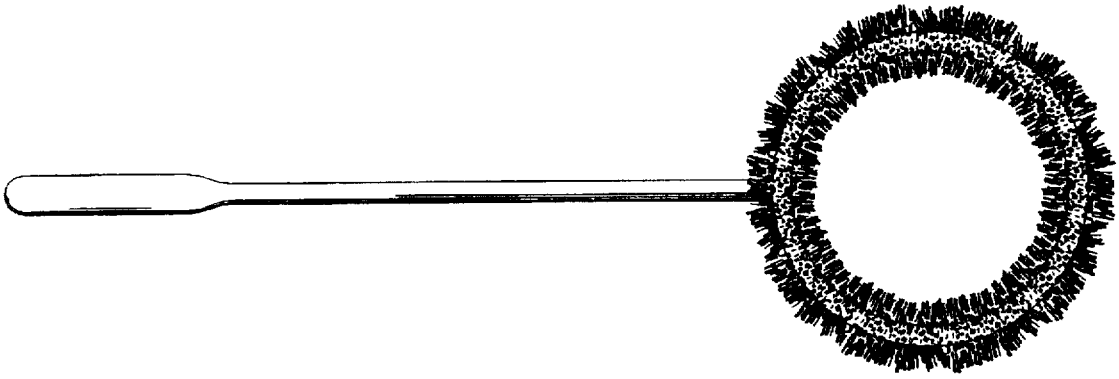

The present invention can further be configured as a toilet bowl cleaner (as shown in FIGS. 14 and 15) . A plastic handle is provided with the material affixed to one end. As such, it can be effectively used for the cleaning of toilet bowls. The material can extend around the exterior surface of the end of the handle in the form of a tube or in the form of a sphere. The fingers should extend outwardly generally transverse to the longitudinal axis of the handle.

Figure 16:
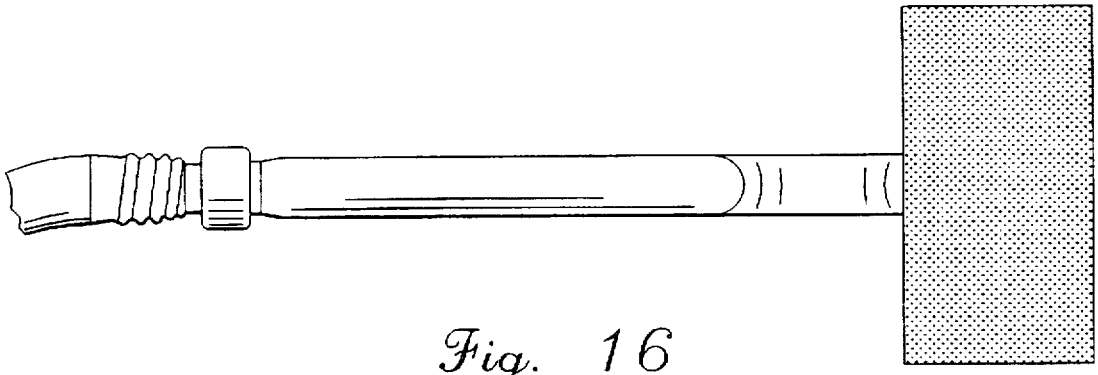
Figure 17:
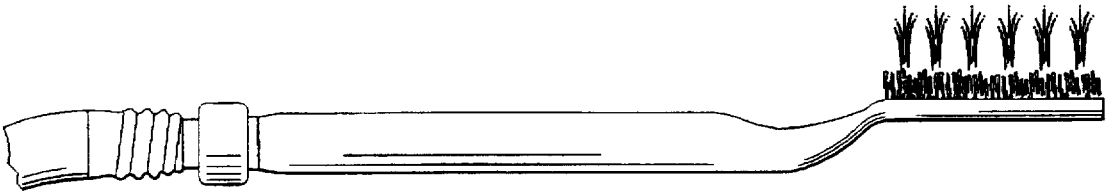

In another alternative embodiment, the present invention can be configured as a window cleaner (as shown in FIGS. 16 and 17). A large piece of soft ASTROTURF (™) material is affixed to the end of a regular-sized mop handle. The handle can also have a tubular configuration so that a hose can be affixed to the end of the handle for the delivery of water through the interior of the handle onto and through the material. As a result, the surface of the material can be used for the cleaning of windows.

Figure 18:
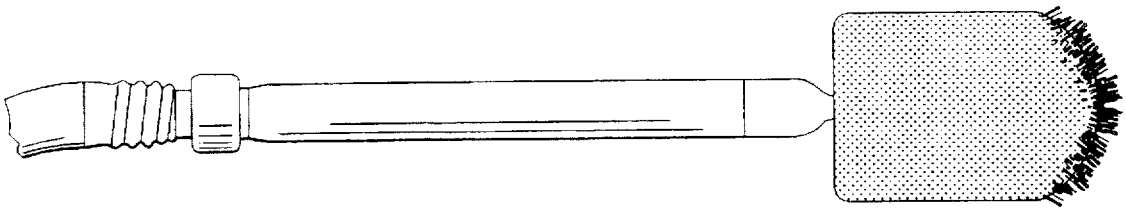
Figure 19:
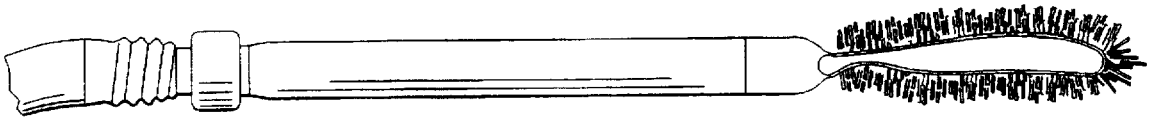

The material of the present invention can further be used for the cleaning of chrome or wire wheels (as shown in FIGS. 18 and 19). The flexible material is affixed on the end of a long or short plastic handle. As with the previous embodiment, the handle can have a conduit extending therethrough such that a water hose can be connected to the handle for the delivery of water directly onto the material. The material can be doubled for extra flexibility.

The present invention can be configured for the grooming of pets. In this configuration, the material can be configured like a glove and have straps affixed to the back surface. As a result, a hand can be received by the straps so as to allow the ASTROTURF (™) material to be used for the grooming of pets, such as horses.

Figure 20:
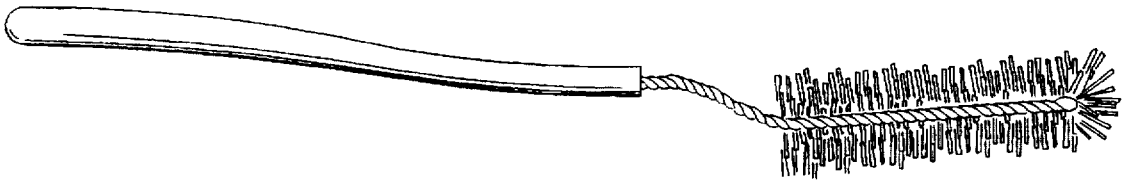

Another embodiment of the present invention is the use of the present invention in conjunction with the cleaning of vegetables and/or kitchenware (as shown in FIG. 20). In this configuration, the ASTROTURF (™) material is affixed on a handle. The material can extend around a wire affixed to the handle so as to facilitate flexibility for the cleaning of vegetables or for the cleaning of kitchenware. The handle facilitates the manipulation and ease of use of the material.

Figure 21:
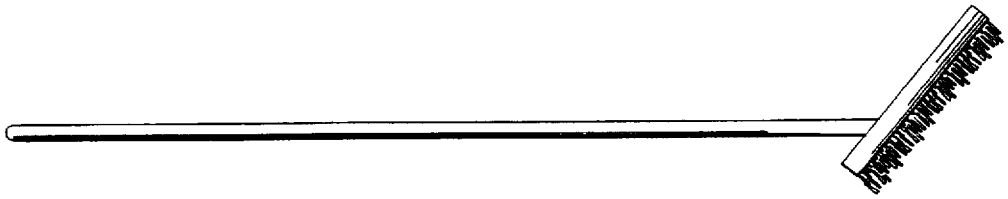
Figure 22:
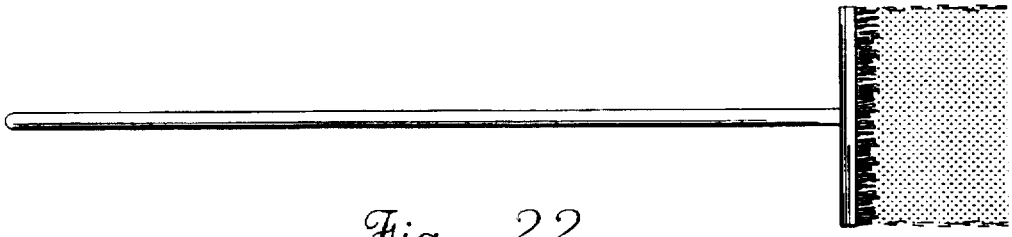

The present invention can further be configured in the form of a mop (as shown in FIGS. 21 and 22). The material is affixed to the end of a long handle. The material will extend outwardly from the end of the handle at an obtuse angle. The material will face one direction so that it can easily be used for the cleaning and scrubbing of floors. Handles can have the length of four feet or more. The material is in the form of a square affixed to the end of a handle.

The foregoing disclosure and description of the invention is illustrative and explanatory thereof. Various changes in the details of the illustrated configuration can be made within the scope of the appended claims without departing from the true spirit of the invention. The present invention should only be limited by the following claims and their legal equivalents.

I claim:

1. A back scrubbing and massaging apparatus comprising:

a backing surface;

a plurality of molded multi-fingered clusters extending outwardly from one side of said backing surface;

a first support bar affixed to an opposite side of said backing surface from said plurality of multi-fingered clusters, said first support bar being of a rigid formable material such that said first support bar retains a shape into which said first support bar is bent, said first support bar extending across at least a portion of said opposite side of said backing surface;

at least one suction cup connected to said first support bar and extending in a direction outwardly from said opposite side, said first support bar including a hinge member formed adjacent to said first suction cup;

a second support bar affixed to an opposite side of said backing surface from said plurality of multi-fingered clusters, said second support bar being of a rigid formable material such that said second support bar retains a shape into which said support bar is bent, said second support bar extending across at least a portion of said opposite side of said backing surface at a location different than said first support bar; and at least one suction cup connected to said second support bar and extending outwardly from said opposite side, said second support bar having a hinge member formed adjacent to said at least one suction cup of said second support bar.

2. The apparatus of claim 1, wherein said first support bar extends longitudinally along and adjacent to a first edge of said backing surface; and said second support bar extends longitudinally along and adjacent to an opposite edge of said backing surface.

3. The apparatus of claim 2, said first and second support bars being in parallel relationship.

4. The apparatus of claim 3, further comprising:

a cross-bar extending between said first and second support bars generally centrally of said first and second support bars.

5. The apparatus of claim 2, each of said first and second support bars being of a rubber-coated metal material.

6. The apparatus of claim 1, said plurality of multi-fingered clusters having a plurality of fingers, each of said plurality of fingers having a length of between ½ and 1 inch.

7. The apparatus of claim 6, each of said plurality of fingers having a length of approximately ¾ inch.

8. The apparatus of claim 1, wherein said first support bar extending diagonally across said backing surface; and said second support bar extends diagonally across said backing surface, said first support bar being transverse to said second support bar.

9. The apparatus of claim 1, wherein each of said suction cups are positioned adjacent respective separate corners of said backing surface.

10. The apparatus of claim 8, wherein each of said at least one suction cup comprises:

a suction cup affixed to one end of each of said support bars; and a suction cup affixed to an opposite end of each of said support bars.

11. The apparatus of claim 10, wherein each of said suction cups are positioned adjacent respective separate corners of said backing surface.

12. The apparatus of claim 2, wherein each of said at least one suction cup comprises:

a suction cup affixed to one end of each of said support bars: and a suction cup affixed to an opposite end of each of said support bars.

* * * * *